US005259497A

United States Patent [19]

Brothers et al.

[11] Patent Number: 5,259,497

[45] Date of Patent: Nov. 9, 1993

[54] HAIRCLIP STRIP

[76] Inventors: Joanne K. Brothers; Bruce T. Brothers, both of 155 Lakeview Dr. #204, Ft. Lauderdale, Fla. 33326

[21] Appl. No.: 12,427

[22] Filed: Feb. 2, 1993

[51] Int. Cl.[5] ..... B65D 73/00

[52] U.S. Cl. ..... 206/6.11; 206/805; 211/13; 211/117

[58] Field of Search ..... 206/495, 477, 805; 211/13, 117, 60.1; 132/276

[56] References Cited

U.S. PATENT DOCUMENTS

| | | | |
|---|---|---|---|
| 1,795,672 | 3/1931 | Plummer | 206/477 X |
| 1,949,465 | 3/1934 | Gammeter | 206/805 X |
| 2,193,215 | 3/1940 | Witter | 211/117 X |
| 3,308,959 | 3/1967 | Repair | 211/13 |
| 4,966,287 | 10/1990 | Snyder | 211/13 |
| 5,027,960 | 7/1991 | Rainville | 211/13 X |
| 5,141,113 | 8/1992 | Elliott | 206/495 X |

*Primary Examiner*—Steven N. Meyers
*Assistant Examiner*—Ted Kavanaugh

[57] ABSTRACT

A long, thick, 1-1½" wide colored elastic band folded and sewn at each end in such a way as to allow a short wooden or plastic dowel through each end. Each dowel is painted and decorated at each end with a cap made of metal with gold or silver finish, or made of plastic. One of the dowels consists of a chain with a chain fastener strewn through one of two holes in the dowel placed on each side of the elastic band, strewn in front of the elastic, and up through the hole of the other end of the dowel, thus allowing for the invention to be hung up and hairclips and hairbows clipped to the elastic band, stretching the elastic for expansion of clipping space.

1 Claim, 1 Drawing Sheet

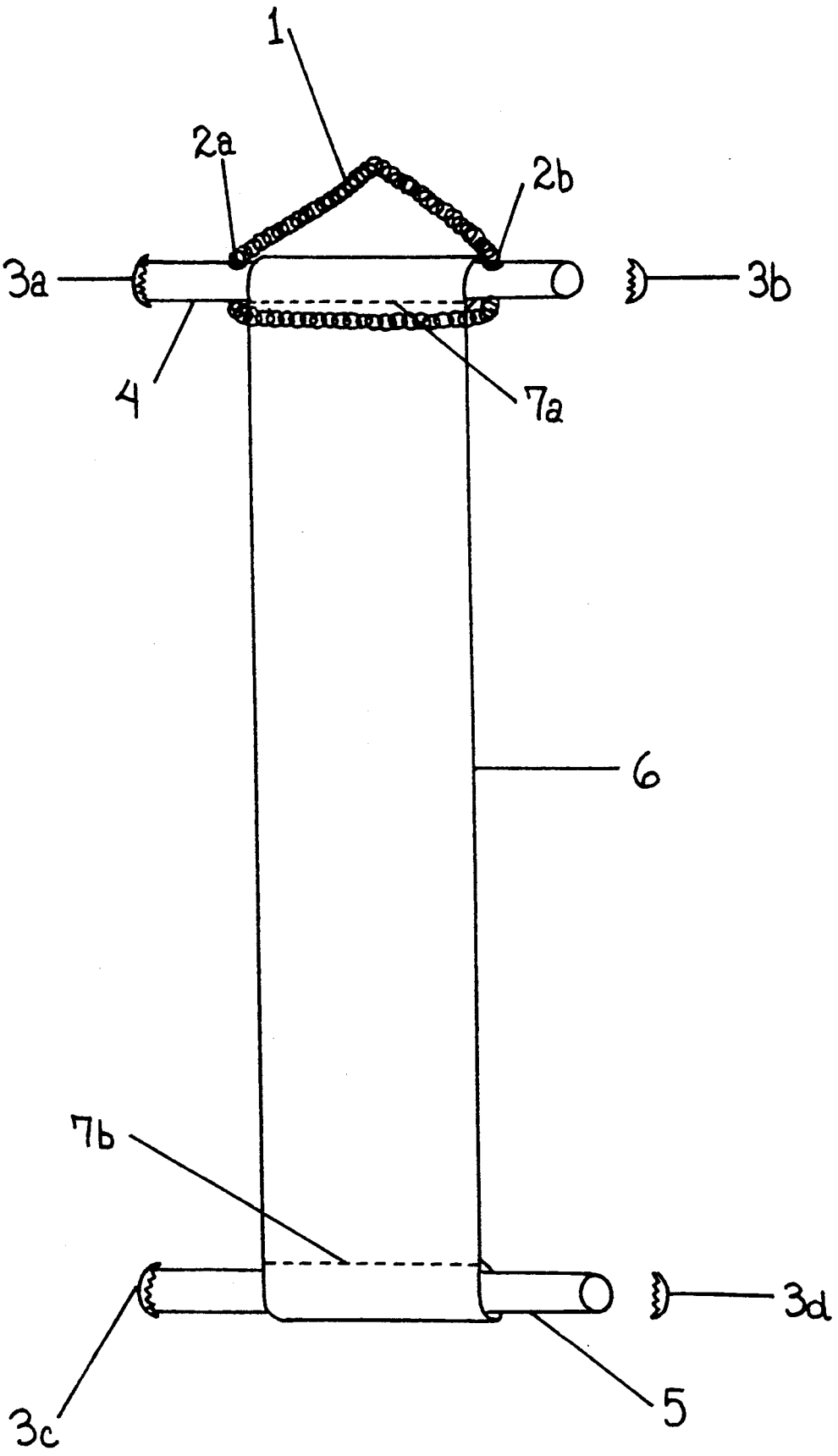
1
2a
2b
3a
3b
4
7a
6
7b
3d
3c
5

HAIRCLIP STRIP

BACKGROUND

This invention relates to hair beauty products, specifically hairclips and hairbows, and its usefulness of design is to hold hairclips and hairbows in such a fashion that would result in an easier method of storage and access versus fumbling through a drawerful of hairbows and hairclips to fine the desired choice.

There is no current invention for this method of storage and access for hairclips and hairbows designed for ordinary household use.

DRAWING

Reference Numbers in Drawing

1: Gold-finished chain with fastener
2: *a,b*: Hole
3: *a,b,c,d*: Metal gold-finished cap
4: 3" long, ⅜" thick wooden dowel with two holes
5: 3" long, ⅜" thick wooden dowel
6: 24" long, 1½" wide, thick elastic band
7: *a,b*: Represents sewing line on elastic to create loop for dowel FIG. 1 shows the various parts which make up the Hairclip Strip.

The two ends of a 24" long, 1½" wide, thick elastic band (6) is folded over and sewn (7*a,b*) in order to allow for a wooden dowel (4 and 5) to be placed through each end.

Each dowel (4 and 5), is 3" in length, is painted black and has a metal gold-finish cap (3*a,b,c,d*) glued to each end (for appearance only).

The top dowel (4) has two holes (2*a,b*), approximately ¾" from each end (on each side of elastic band (6)), in order for the chain (1) to run through.

The chain (1) is strung through a hole (2*a*) on one side, across the front of the elastic band (6), and up through the hole (2*b*) on the other side. It is then fastened together like a necklace, with the metal chain fastener.

Appearance Variables

Chain (1)—Any color chain and chain fastener may be used.

Elastic Band (6)—This can be any color elastic and, in addition, an attractive design can be painted on the elastic.

Dowels (4 and 5)—Wooden, ⅜" thick and 3" long is solely used for the purpose of presenting the dowel's function relating to this invention, the thickness and length may vary, and the dowel can be made of plastic. In addition, the dowel can be painted any color.

Caps (3)—The metal caps for the end of each dowel can be gold or silver finish, and can even be made of plastic.

Operation

The manner of using the Hairclip Strip is simply clipping hairclips anywhere on the elastic band, stretching the elastic to create additional space if needed.

The chain with fastener allows for hanging the Hairclip Strip on a hook or nail or, upon opening the fastener, can be placed on a stationary item, such as a towel bar or rod. Because the invention is so lightweight, we feel and have implemented the "ideal" to be hanging the Hairclip Strip on a bathroom mirror from a suction cup with a hook.

SUMMARY

This invention was designed in a common household to meet a common household need. It's usefulness is apparent in that it:

1) Provides quick and easy access and storage of hairclips and hairbrows.
2) Is easy to operate.
3) Is lightweight and easy to place in a convenient location.
4) Can hold many hairclips, stretching to accomodate capacity needs.

Although the description above contains specifics, these should not be construed as limiting the scope of the invention but as merely providing illustration of some of the preferred features of this invention.

We claim:

1. A hairclip strip for holding hairclips and hairbows comprising a long, thick, colored, elastic band substantially 1½" wide with ends that are folded over and sewn forming a loop on each end, two short, colored dowels that are placed in said loops having two holes drilled in each and end caps glued on both ends of said dowels wherein the elastic band is positioned between said holes, a chain with a chain fastener strewn through one of the two holes, across the front of the elastic band and up through the other of said two holes on the other side of said dowel, wherein said hairclip strip is to be hung so that hairclips and hairbows can be clipped to said elastic band and further stretched to accommodate extra clipping space.

* * * * *